US007127849B1

(12) United States Patent
Gayer

(10) Patent No.: US 7,127,849 B1
(45) Date of Patent: Oct. 31, 2006

(54) MANWAY LIFT DEVICE HAVING AN ADJUSTABLE BIASING ASSEMBLY THEREFOR

(76) Inventor: Jason E. Gayer, 4950 South Jewell, Springfield, MO (US) 65810

( * ) Notice: Subject to any disclaimer, the term of this patent is extended or adjusted under 35 U.S.C. 154(b) by 323 days.

(21) Appl. No.: 10/671,108

(22) Filed: Sep. 25, 2003

Related U.S. Application Data

(60) Provisional application No. 60/413,831, filed on Sep. 26, 2002.

(51) Int. Cl.
*E05F 15/04* (2006.01)

(52) U.S. Cl. ..... 49/386; 49/399; 49/402; 52/20

(58) Field of Classification Search ..... 49/386, 49/397, 399, 402, 379; 16/285, 289, 292, 16/298, 300, 388; 52/19, 20
See application file for complete search history.

(56) References Cited

U.S. PATENT DOCUMENTS

| | | | | | |
|---|---|---|---|---|---|
| 294,746 | A * | 3/1884 | Straup et al. | ..... | 16/330 |
| 317,410 | A * | 5/1885 | Niles | ..... | 16/300 |
| 709,193 | A * | 9/1902 | Barson | ..... | 49/386 |
| 2,547,550 | A * | 4/1951 | Whitmore | ..... | 16/298 |
| 2,626,421 | A * | 1/1953 | Lyons | ..... | 16/300 |
| 2,823,413 | A | 2/1958 | Stewart | | |
| 3,459,462 | A | 8/1969 | Barnard et al. | | |
| 4,137,669 | A | 2/1979 | Nunlist | | |
| 4,709,445 | A * | 12/1987 | Waldo et al. | ..... | 16/300 |
| 5,394,650 | A | 3/1995 | Dean | | |
| 5,465,862 | A * | 11/1995 | Devlin | ..... | 220/830 |
| 5,904,411 | A * | 5/1999 | Hayakawa | ..... | 312/319.2 |
| 6,446,307 | B1 | 9/2002 | Wilkins | | |
| 2003/0172494 | A1 * | 9/2003 | Oshima et al. | ..... | 16/285 |

* cited by examiner

*Primary Examiner*—Gregory J. Strimbu
(74) *Attorney, Agent, or Firm*—Richard L. Marsh

(57) ABSTRACT

A manway lift device comprises two hinge assemblies, each hinge assembly comprising a first hinge member, a second hinge member, a smooth bore bushing, an internally threaded bushing and an adjustable biasing assembly. At least one of the bushings of each hinge assembly including a first end protruding beyond an exterior face of the first hinge member of the hinge assembly and including a second end having dogs disposed thereon, the dogs engaged in dog holes disposed through the second hinge member of the hinge assembly. The smooth bore bushing of each hinge assembly receiving a bolt through the internal bore thereof, the bolt threaded received in the internally threaded bore of the threaded bushing of the hinge assembly. The bolts rigidly affix the bushings to the hinge assemblies. Each hinge assembly connected to a manway cover and a manway collar. The biasing assemblies biasing the manway cover toward an open position with respect to the manway collar.

17 Claims, 2 Drawing Sheets

MANWAY LIFT DEVICE HAVING AN ADJUSTABLE BIASING ASSEMBLY THEREFOR

RELATED APPLICATION DATA

This application is a non-provisional application of provisional application of 60/413,831 filed on Sep. 26, 2002.

BACKGROUND OF THE INVENTION

1. Field of the Invention

This invention relates to a manway lift assist mechanism, a spring actuated lift assist assembly therefor, the lift assist assembly comprising a hinge assembly and flat spiral springs housed within substantially closed cover assemblies for protection from the environment. The number of hinge assemblies required for a manway as well as the number of lift assist assemblies for each hinge assembly is dictated by the weight of the cover and the resultant lifting force required. The lift assist assemblies of this invention produce a torque opposing the torque resulting from the cover weight thus reducing the required lifting force to an ergonomically acceptable value.

2. Prior Art Statement

Traditionally, manways have been used to gain access to the interior of pressurized and non pressurized vessels. The manway consists of a cover and a collar assembly, the collar assembly welded to the top or sidewall of the vessel. To facilitate opening of the manway cover, at least one hinge is typically attached at a point exterior to the manway cover with a lift handle attached to the cover at a point furthest from the hinge. Due to an ever growing concern over industrial ergonomics, better methods of reducing the force required to lift the cover are being sought. Looking at the problem as a function of torque, the weight of the cover in the closed position produces torque based upon the distance from the center of gravity of the cover to the pivot point of the hinge. To open the manway, a lifting force is applied utilizing the handle. This lifting force is applied to produce a torque opposite and greater than that of the torque produced by the weight of the cover, thus opening the manway.

It is known to provide a door closer for mounting on a door member or jamb member comprising a base plate, a plurality of laterally spaced and aligned bearings carried by the base plate, laterally spaced actuator arms interconnected at their outer ends and means carried by the outer arm ends for establishing an operative connection with the other of the door and jamb members, a shaft projected through the plate and the arm bearings and pivotally securing the actuator arms to the base plate in combination with a plurality of its coils springs spaced in the direction of the length of the shaft and surrounding the same. For instance, see the U.S. Pat. No. 2,823,413 issued on Feb. 18, 1958 to Kenneth M. Stewart. The closing force of the door may be changed by lifting an end of one of the springs from the actuator arm, however, external adjustment is otherwise limited without removal of the door closer from the door. Furthermore, the door closer of Stewart is unprotected the from the environment and is subject to damage from environmental factors. Additionally, no latch is incorporated into the door closer in order to retain the door in an open or partially open position. The device of Stewart is inappropriate for a manway cover, therefore, there is a need for a lifting assist mechanism that comprises multiple lifting assist mechanisms, provides for placement of a retaining clamp between the hinges and provides means for locking the manway in the open position.

It is also known to constantly urge a lid into an open position by a pair of helical springs for each hinge pin through which the pin extends. Two separate hinge pins are shown, each hinge pin having a pair of helical springs disposed therearound. In the order to limit the upward movement of the lid to a preselected position, stops are provided. For instance, see the U.S. Pat. No. 3,459,462 issued on Aug. 5, 1969 to Barnard, et al. As with Stewart above, no means is provided externally to adjust the spring force supplied by any of the springs, nor is there a latch to retain the lid in any one of a plurality of positions. Additionally, the device described by Barnard, et al., is also unprotected from environmental factors and therefore cannot be used in rigorous environments such as for a manway cover. A need exists for a lifting assist mechanism that may readily be adjusted for the appropriate lifting force, is protected from the environment and provides means for locking the manway in the open position.

It is further known to provide a balancing aid for pivotally mounting a manhole cover comprising a stack of conical disc spring and means to compress the stack of springs as the cover pivots from an open vertical position to a closed, substantially horizontal position wherein the stack of springs comprises a first subset of springs having a first diameter and a second subset of springs having a different diameter, the first subset of springs having a steeper spring force characteristic curve than the second set whereby the overall spring force characteristic curve of the combined stack of springs as the cover pivots from the open vertical position to the closed position is progressive. For instance, see U.S. Pat. No. 4,137,669 issued on Feb. 6, 1979 to Erwin Nunlist. Though effective in assisting with lifting the manhole cover, failure of any part results in loss of lifting force. Furthermore, though the manhole cover can be balanced in any position, no means of locking the manhole cover in the open position is present. Finally, since the balancing aid is disposed between the hinges, the space between the hinges is completely obscured and placement of a retaining clamp between the hinges is not possible. Therefore, there remains a need for a lifting assist mechanism for a manway cover that comprises multiple lifting assist mechanisms, provides for placement of a retaining clamp between the hinges and provides means for locking the manway in the open position.

Additionally, it is known to provide a retro-fit cover balance assembly comprising a pair of torsion springs having one end passed beneath the cover hinge members and bearing upon the collar hinge member. The through bolt is removed, a spring cup is arranged adjacent each side edge of the cover hinge members, the springs are disposed over the spring cups and the through bolt replaced. Holes for eye bolts are provided in the cover hinge members disposed away from the center of rotation and the free end of the springs are inserted through the eye bolts. Access to retaining clamps would not be possible between the cover hinge members, nor is the balance mechanism protected from the environment, nor is there external adjustment of the spring tension. For instance, see the U.S. Pat. No. 5,394,650 issued on Mar. 7, 1995 to Robert Dean.

Finally, it is known to provide a compression spring which moves a cam member against the underside of the manway cover to help in lifting the manway cover. External adjustment of the spring force is provided by an external bolt head. The spring is housed in an enclosure. Access to a retaining clamp between the cover hinge members would be denied. For instance, see the U.S. Pat. No. 6,446,307 B2 issued on Sep. 10, 2002 to Larry C. Wilkins.

SUMMARY OF THE INVENTION

Though lifting of a light weight manway cover might be accomplished without the use of assistance, generally, manway covers are of sufficient mass to require assistance in raising the manway cover for access through the manway opening. The prior art has examples of various methods of lifting a vessel cover, such as a manway cover, including but not limited to spring assists, hydraulics, pneumatics and mechanical means. The devices of the prior art accomplish the function for which each is intended, however, the prior art does not provide for locating a retaining clamp for the manway cover between the hinges, generally does not adequately protect the lifting mechanism from the environment and does not provide for ease of assembly or multiple means for adjustment. Therefore, it is an object of this invention to provide an adjustable biasing assembly comprising mating inner and outer housing and at least one flat wire spiral wound spring, the spring disposed between the inner and the outer housing, the outer housing rotatably engaged in the inner housing, the outer housing having at least one internal lug engageable with the outer end of the spring.

Additionally, the prior art does not provide a mechanism which can be reversed to provide for closing force. Therefore, it is another object of this invention to provide an adjustable biasing assembly adapted for use with rotatably associated fixed and rotatable members which are angularly biased by a flat spiral wound spring wherein the rotatably associated fixed and rotatable members may be biased in an opening relationship or by reversing the orientation of the spring and associated adjusting members provide for biasing in a closing relationship.

It is still another object of this invention to provide a lift assist mechanism comprising rotatably associated fixed and rotatable members which are angularly biased by a flat spiral wound spring wherein the rotatably associated fixed and rotatable members have integrally disposed abutting stops to prevent relative movement beyond a predetermined angular displacement.

An aim of this invention is to provide a lift assist mechanism comprising rotatably associated fixed and rotatable members which are angularly biased by an adjustable biasing assembly, the rotatably associated fixed and rotatable members having integrally disposed abutting stops to prevent relative movement beyond a predetermined angular displacement and wherein the fixed member has a latch mechanism rotatably associated therewith, the latch mechanism comprising a latch arm having a latch hook on one end thereof, the latch hook engagable with a latch cusp carried by the rotatable member to arrest angular movement in a closing direction.

A goal of this invention is to provide a lift assist mechanism comprising rotatably associated fixed and rotatable members which are angularly biased by an adjustable biasing assembly wherein the biasing assembly has mating inner and outer housings and further has at least one flat wire spring disposed between the mating housings wherein an outer end of the flat spiral wound spring is engaged by an internal lug of the outer housing.

A feature of this invention is to provide a lift assist mechanism comprising rotatably associated fixed and rotatable members which are angularly biased by one flat spiral wound spring enclosed within mating inner and outer housings wherein the available torque of the biasing assembly is adjustable by disposing an additional flat wire spring between the mating housings.

An aim of this invention is to provide a lift assist mechanism comprising rotatably associated fixed and rotatable members which are angularly biased by at least one flat spiral wound spring enclosed within mating inner and outer housings wherein an internal lug disposed within the outer housing engages the curved outer end of the flat wire spring, the outer housing adjustably associated with the inner housing thus rendering the biasing assembly adjustable.

A principle of this invention is to provide a lift assist mechanism comprising rotatably associated fixed and rotatable members which are angularly biased by at least one flat spiral wound spring enclosed within mating inner and outer housings wherein the outer housing has at least one stop, preferably six, disposed on an outer rim thereof adapted to engage at least one internally disposed stop, preferably six, on the mating inner housing.

A significant feature of this invention is to provide a lift assist mechanism comprising a pair of rotatably associated members, a central bushing set and a biasing device, one of the members having the central bushing set affixed thereto and the other of the members rotatably pivoting upon a bearing surface of the bushing set, the rotatably associated members biased relative one to the other by the biasing device, the biasing device having one end thereof affixed to the central bushing set and the opposite end thereof affixed to one of the members.

A purpose is this invention is to provide a manway lift device which comprises a right and a left upper hinge bracket, a right and a left lower hinge bracket, at least two smooth bore bushings, at least two internally threaded bushings and at least one biasing assembly, the upper hinge brackets arranged in a parallel relationship, spaced apart and rigidly attached to the manway cover to be lifted, the lower hinge brackets arranged in a parallel relationship, spaced apart and rigidly affixed to a manway collar assembly receiving the manway cover, the right upper hinge bracket aligned with the right lower hinge bracket thus constituting a right-aligned pair, the left upper hinge bracket aligned with the left lower hinge bracket thus constituting a left-aligned pair, the right-aligned pair receiving one of the smooth bore bushings and one of the internally threaded bushings therethrough from opposite directions thus comprising a bushing set, the left-aligned pair receiving one of the smooth bore bushings and one of the internally threaded bushings therethrough from opposite directions thus comprising a bushing set, at least one of the bushings having a boss on one end thereof protruding beyond an exterior face of the lower hinge bracket and having dogs disposed on the opposite end thereof, the dogs engaged in dog holes disposed through the upper hinge bracket, the smooth bore bushing of the bushing set receiving a bolt through the internal bore thereof, the internally threaded bushing of the bushing set threadedly receiving the threaded end of the bolt in the internally threaded bore thereof, the bolt thus rigidly affixing the bushing set to the upper hinge bracket and thereby rotatably affixing the manway cover to the manway collar assembly, at least one of the bosses having a lift assist assembly associated therewith wherein the lift assist assembly comprises at least one biasing assembly.

It is also a feature of this invention to provide a manway lift device wherein a lift assist assembly is disposed on a left-aligned pair of rotatably associated hinge members and a lift assist assembly is disposed on the right-aligned pair of rotatably associated hinge members thereby permitting a manway cover retaining clamp to be located between the left-aligned pair of rotatably associated hinge members and the right-aligned pair of rotatably associated hinge members.

Another purpose of this invention is to provide a manway lift device comprising a right and a left-aligned pair of rotatably associated hinge members each of said rotatably associated hinge members carrying a lift assist assembly wherein the lift assist assembly disposed on the left-aligned pair of members comprises two opposed co-acting biasing assemblies and the lift assist assembly disposed on the right-aligned pair of members comprises two opposed co-acting biasing assemblies and wherein the lifting torque of the lift assist assemblies disposed on the aligned pairs is externally adjustable.

DESCRIPTION OF THE PREFERRED EMBODIMENTS

While the various features of this invention are hereinafter described and illustrated as rotatably associated members angularly biased by a flat, spiral wound spring having an internal end thereof anchored in a bushing fixedly retained in one of the members, the spring having its outer end thereof angularly adjustably associated with the other of the members, it is to be understood that the various features of this invention can be used singly or in various combinations thereof to provide adjustable biasing assemblies for a variety of purposes and/or lift assist mechanisms for manway covers as can hereinafter be appreciated from a reading of the following description.

Figure 2:
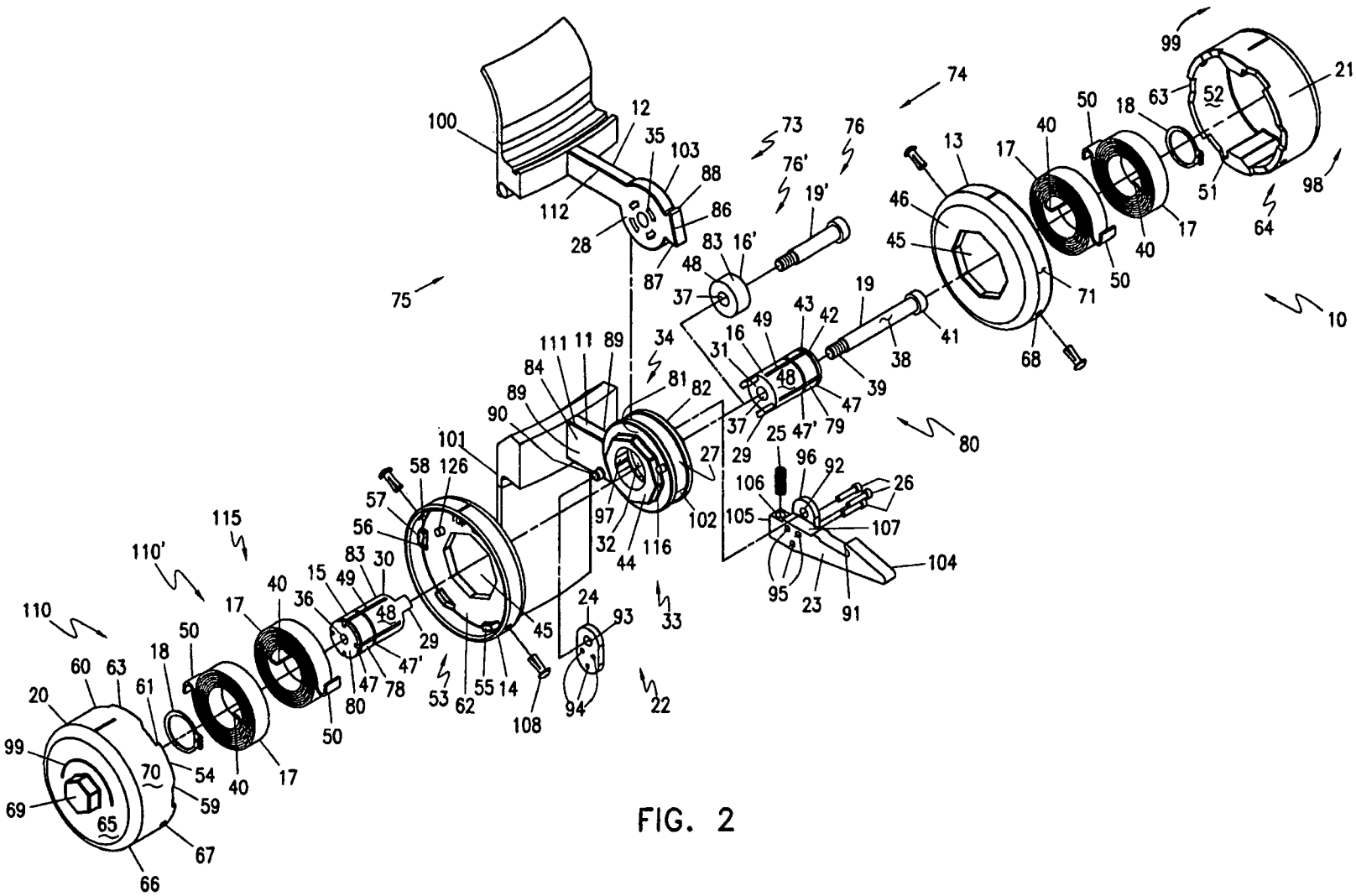
FIG. 2 is an exploded perspective view of the preferred embodiment of the lift assist mechanism of the manway lift device of this invention showing two adjustable biasing assemblies.

Referring now to the Figures, in a manway for providing access to a closed container, two parallel upper hinge brackets 12 are rigidly attached to a manway cover 100 and two lower hinge brackets 11 are rigidly affixed to the manway collar assembly 101, the slots 27 within lower hinge brackets 11 receiving a rotatable portion 28 of upper hinge brackets 12 therewithin. The manway cover 100 is then concentrically placed upon manway collar assembly 101 with upper hinge brackets 12 and lower hinge brackets 11 aligned, rotatable portions 28 of upper hinge brackets 12 received within the slots 27 in the respective lower hinge brackets 11. Referring now to one hinge pair 11, 12 as shown in FIG. 2, hinge bracket 12 is pivotally mounted to hinge bracket 11 with at least one pivot bushing 15, though an additional pivot bushing 16 is preferably used for the opposed side of the hinge pair 11, 12, wherein dog ends 30, 31 of pivot bushings 15, 16, respectively are inserted through an elongated hole 32 on opposed sides 33, 34 of lower hinge bracket 11. Pivot bushing 15 preferably has an internally threaded bore 36 for receiving the threaded end 39 of a shoulder bolt 19 therewithin, shoulder bolt 19 having a shoulder portion 38 adapted to be passed through a through bore 37 in pivot bushing 16 with head 41 of shoulder bolt 19 received within a socket 42 disposed into boss end 43 of pivot bushing 16. Shoulder bolt 19 is then inserted through through bore 37 in pivot bushing 16 and into threaded internal bore 36 of pivot bushing 15. Upon tightening shoulder bolt 19 into threaded internal bore 36 of pivot bushing 15, a rigid engagement is established between pivot bushings 15, 16 and upper hinge bracket 12 and thus manway cover 100 is pivotally mounted to manway collar assembly 101 allowing proper opening and closing of the manway. A bearing surface 83 adjacent dog ends 30, 31 of pivot bushings 15, 16 respectively, is adapted to bear the weight of manway cover 100 by rotating upon an internal surface 97 of elongated hole 32 disposed in lower hinge bracket 11.

In order to provide powered assist in lifting manway cover 100 from manway collar assembly 101, at least one adjustable biasing assembly 10 is associated with hinge brackets 11, 12 acting through bushings 15 and/or 16, thus constituting a lift assist assembly 110. Adjustable biasing assembly 10 comprises at least one spiral wound flat wire power spring 17, at least one inner spring housing 13 or 14 and at least one outer spring housing 20 or 21, however, adjustable biasing assembly 10 may contain multiple power springs 17 disposed within mating spring housings 13, 21 and/or 14, 20. In this preferred application of providing a lift assist assembly 110 for lifting manway cover 100 from manway collar assembly 101, the description hereinafter will generally refer only to one hinge pair 11,12 and the associated adjustable biasing assemblies 10 though it should be fully understood that manway cover 100 and associated manway collar assembly 101 generally has two hinge pairs 12, 11 respectively, welded thereto.

Referring now to FIG. 2, pivot bushing 15 has two dogs 29 protruding from dog end 30 and pivot bushing 16 likewise has two dogs 29 protruding from its dog end 31, the configuration of dogs 29 in pivot bushing 15 and pivot bushing 16 being substantially the same. Dog ends 30, 31 of pivot bushings 15, 16, respectively are inserted through elongated hole 32 on opposed sides 33, 34 of lower hinge bracket 11 with dogs 29 received into complementary shaped dog holes 35 in rotatable portion 28 of upper hinge bracket 12. It is readily apparent that dogs 29 of pivot bushing 15 are oriented 90 degrees from dogs 29 of pivot bushing 16 thus allowing pivot bushings 15, 16 to both be fixedly associated with upper hinge bracket 12. Pivot bushing 15 has internally threaded bore 36 for receiving the threaded end 39 of a shoulder bolt 19 therewithin, shoulder bolt 19 having a shoulder portion 38 adapted to be passed through through bore 37 in pivot bushing 16. Shoulder bolt 19 is then inserted through through bore 37 in pivot bushing 16 and into threaded internal bore 36 of pivot bushing 15. Upon tightening shoulder bolt 19 into threaded internal bore 36 of pivot bushing 15, a rigid engagement is established between pivot bushings 15, 16 and upper hinge bracket 12 and thus pivot bushings 15, 16 move in concert with upper hinge bracket 12 when manway cover 100 is pivoted relative to manway collar assembly 101.

Lower hinge bracket 11 preferably has an enlarged octagonal protrusion 44 on both side faces 81, 82 thereof, enlarged octagonal protrusion 44 substantially centrally disposed around elongated hole 32, octagonal protrusions 44 receiving an octagonal aperture 45 disposed through the closed end wall 46 of inner spring housings 13, 14. Inner spring housings 13, 14 are mirror image in construction having internal features thereof that mate with corresponding external features of outer spring housings 21, 20 such that inner spring housing 13 and outer spring housing 21 comprise a right side pair and inner spring housing 14 and outer spring housing 20 comprise a left side pair, the mating features of these pairs of spring housings 13/21, 14/20 to be hereinafter fully explained. By utilizing the mating octagonal apertures 45 of inner spring housing 13 and/or 14 and octagonal bosses 44 of lower hinge bracket 11, respectively, a non-rotating engagement between inner spring housing 13 and/or 14 with lower hinge bracket 11 is established. Thus, in this preferred application, inner spring housing 13 and/or 14 remains engaged with lower hinge bracket 11 and subsequently to manway collar assembly 101. Inner spring housing 13 and/or 14 is not affixed to lower hinge bracket 11, however inner spring housing 13 and/or 14 will be held in engagement with lower hinge bracket 11 by the installation of at least one power spring 17 retained upon bushings 15, 16 by a retainer clip 18 disposed in an annular groove 47, 47' machined into the outer peripheral surface 48 of bushings 15, 16. Preferably, two power springs 17 are then axially mounted to bushing 15, 16 on the same side 33 or 34 of lower hinge bracket 11 utilizing longitudinal slots 49 disposed into outer peripheral surface 48 of bushings 15, 16 to retain the inner end 40 of power springs 17 therein. It is preferred that the open ends 50 of adjacent pairs of power springs 17 disposed upon one bushing 15, 16 are diametrically opposed in order to negate any significant end force upon outer housing 21. For instance, when mounting two power springs 17 to bushings 15, 16, one power spring 17 has its free outer end 50 arranged at a 3 o'clock position while the other power spring 17 has its free outer end 50 arranged at a 9 o'clock position. As will become readily apparent hereinafter, power spring 17 having free outer end 50 arranged at the 9 o'clock position has free end 50 opening upwardly and power spring 17 having free outer end 50 arranged at 3 o'clock position has free end 50 opening downwardly. Though power springs 17 preferably have ends 50 diametrically opposed, it is within the scope of this invention to provide for unbalanced orientation. Upon assembly of power springs 17 to pivot bushings 15, 16, retainer clip 18 is disposed adjacent the outer most power spring 17 into annular groove 47. Where only one power spring 17 is assembled to pivot bushing 15 and/or 16, retainer clip 18 is disposed into the inner most annular groove 47' disposed into outer peripheral surface 48 of bushing 15 and/or 16. At this point, inner end 40 of power spring 17 is rotatably associated with upper hinge bracket 12 through bushings 15 and/or 16 though no power assist is provided for lifting manway cover 100 from manway collar assembly 101 as free outer end 50 of power spring 17 is not yet associated with lower hinge bracket 11. As will be fully explained hereinafter, free outer end 50 of power spring 17 will be associated with lower hinge bracket 11 by capturing free outer end 50 with one of internally disposed lugs 51 disposed on an internal surface 52 of external rim 63 of outer spring housing 20, 21 though internal lugs 51 are only visible in outer spring housing 21. Though lugs 51 are shown disposed entirely within the confines of peripheral wall 63, it is within the scope of this invention to dispose lugs 51 through peripheral wall 63 as slots longitudinally through peripheral wall 63 wherein outer end 50 of power spring 17 would be engaged by lug 51 upon assembly of outer spring housing 20, 21. It should be readily apparent here, that the number of adjustable biasing assemblies 10 and/or the number of power springs 17 disposed on bushing 15 and/or 16 depends upon the torque required to raise manway cover 100 from manway collar assembly 101. Generally, at least one power spring 17 is disposed within at least one of housing pairs 13/21, 14/20 on each hinge pair 11, 12. Where the mass of manway cover 100 is substantial, two power springs 17 are disposed within each housing pair 13/21, 14/20 on each hinge pair 11, 12 and thus a total of eight power springs 17 are available to assist in lifting manway cover 100 from manway collar assembly 101.

Upon assembling the required number of power springs 17 to pivot bushings 15 and/or 16, outer spring housing 20 and/or outer spring housing 21 is axially positioned to enclose power springs 17. Preferably, inner spring housings 13, 14 and outer spring housings 20, 21 are marked with a preferred orientation such that assembly of outer spring housings 20, 21 to inner spring housings 14, 13, respectively, is easily accomplished. Once axially positioned and properly oriented, outer spring housing 20 and/or outer spring housing 21 is pressed firmly inwardly into the open cup shaped portion 53 of the respective inner spring housing 14 and/or 13. While continuing to apply axial pressure upon outer spring housing 20 and/or 21, outer spring housing 20 and/or 21 is rotated in the proper direction to engage internal lugs 51 with outer ends 50 of power springs 17. By engaging internal lugs 51 with outer ends 50 of power springs 17, power springs 17, when rotated through an angular displacement, provide the required lifting torque to assist in raising manway cover 100 from manway collar assembly 101. The lifting torque provided by power spring 17 may additionally be adjusted by choosing one of a multiple of available angular displacements between the outer spring housings 20, 21 with the respective inner spring housings 14, 13, the multiple of angular displacements hereinafter explained. Where more than two power springs 17 are installed upon central bushing set 76, it may be necessary to provide for a bearing surface through outer spring housing 20, 21 to provide support for outer spring 20, 21 thus reducing the tendency for outer spring housing 20, 21 to become cocked relative to the respective inner spring housing 14, 13. The bearing surface, not shown, may be disposed through hexagonal boss 69 or disposed into a surface opposite surface 65.

Referring now to inner spring housing 14 and to outer spring housing 20 appearing on the left side of FIG. 2, it being understood that inner spring housing 13 and outer spring housing 21 are substantially equal but of mirror image, an external rim 63 is disposed peripherally about the open side 64 of cup shaped outer spring housing 20. External rim 63 preferably has a plurality of external pawls 54 disposed thereabout, each external pawl 54 comprising a ramp portion 59, a flat portion 60 and a stop portion 61, stop portion 61 disposed substantially perpendicular to external rim 63 and adapted to engage a similar stop 58 disposed within inner spring housing 14. The plurality of external pawls 54 permit engagement of outer spring housing 20 with inner spring housing 14 in a plurality of circumferential positions thus providing for external adjustment of the lifting torque required of adjustable biasing assembly 10 of lift assist assembly 110 as power springs 17 may be wound to a plurality of torques associated with the plurality of circumferential positions. Disposed on an internal surface 62 of closed end wall 46 of inner spring housing 14 is a plurality of internal ratchets 55, ratchets 55 comprising a ramp 56, a flat 57 and stop 58, stop 58 disposed substantially perpendicular to internal surface 62 such that stop 61 of external pawl 54 will firmly engage stop 58 of internal ratchet 55. Ramps 59 and 56 are provided on external pawls 54 and internal ratchets 55, respectively, in order to provide for ease in winding power springs 17 without pulling outer spring housing 20 away from inner spring housing 14. Flats 57 of internal ratchets 55 and flats 60 of external pawls 54 space apart internal ratchets 55 on internal surface 62 and external pawls 54 about external rim 63. It has been found by the inventor hereof that six external pawls 54 and six internal ratchets 55 are sufficient to provide for the plurality of circumferential positions thus providing adjustable torque settings for adjustable biasing assembly 10. These additional mating features, that is, external pawls 54 and internal ratchets 55 insure that outer spring housing 20 locks in position at increments of rotation in order to resist counter rotation of outer spring housing 20 as power springs 17 are being wound to the torque setting required. Upon engaging internal lugs 51 of outer spring housing 20 with free outer ends 50 of power springs 17 and engaging stops 61 against stops 58, power springs 17 are thus now associated with lower hinge bracket 11. Outer spring housings 20, 21 are provided with a hexagonal boss 69 on the outer surface 65 thereof, hexagonal boss 69 adapted to be engaged with a wrench in order to rotate outer spring housing 20, 21 for further winding power springs 17 beyond a torque setting possible using only hand rotation of outer spring housing 20, 21. Since power springs 17 will be unwinding when raising manway cover 100 from manway collar assembly 101, power springs 17 may be wound to a position where the individual coils thereof are substantially touching thus providing the maximum torque available though, of course, power springs may be wound to a lesser torque for a lesser load as hereinbefore stated.

Outer spring housing 20, 21 is removably retained upon inner spring housing 14, 13 respectively by removable rivets 108 disposed through rivet holes 67 in outer peripheral wall 70 of outer spring housing 20, 21 and into holes 68 drilled through outer peripheral wall 71 of inner spring housing 14, 13, respectively. The removable rivets 108 are provided to guard against counter rotation of outer spring housing 20, 21 that may be caused by accidental jarring of outer spring housing 20, 21 while working around manway cover 100. Additionally, drain holes 66 are provided in outer peripheral wall 70 of outer spring housing 20, 21 in order to relieve any buildup of moisture within the outer spring housing 20, 21 and inner spring housing 14, 13, respectively. In the preferred embodiment, upper hinge bracket 12, lower hinge bracket 11, power springs 17, retainer clip 18, shoulder bolt 19 and pivot bushings 15, 16 are preferably stainless steel and inner spring housings 13, 14 and outer spring housings 20, 21 are formed from glass-filled polymer.

Adjustable biasing assembly 10 comprises mating inner and outer spring housings 13, 21 respectively, and at least one flat wire spiral wound power spring 17, power spring 17 disposed between inner 13 and outer spring housing 21, outer spring housing 21 rotatably engaged in inner spring housing 13, outer spring housing 21 having at least one internal lug 51 engageable with the outer end 50 of power spring 17. Adjustable biasing assembly 10 is preferably associated with a fixed member 111, such as lower hinge bracket 11, a rotatable bushing set 76 comprised of bushings 15 and 16 and a rotatable member, such as upper hinge bracket 12, for angularly biasing rotatable member 112 with respect to fixed member 111. Inner spring housing 13 is carried by fixed member 111, fixed member 111 having rotatable bushing set 76 passing therethrough, rotatable bushing set 76 fixedly engaged in rotatable member 112 with bushing set 76 receiving and retaining inner end 40 of power spring 17 therein. By rotating outer spring housing 21 clockwise as shown by arrow 99, fixed member 111 and rotatable member 112 are biased by power spring 17 in an opening relationship. As can be observed on outer surface 65 of outer spring housing 20, direction arrow 99 is embossed thereupon. Where two adjustable biasing assemblies 10 are mounted to boss ends 80 and 43 of bushings 15, 16, respectively, it is readily apparent that by rotating both outer spring housings 20, 21 in a clockwise direction shown by arrow 99, a greater torque between fixed member 111 and rotatable member 112 is established. Furthermore, it should be readily apparent that by reversing the locations of adjustable biasing assemblies 10, that is, by placing biasing assembly 10 comprising power springs 17, inner spring housing 13 and outer spring housing 21 upon boss end 80 of bushing 15 and likewise placing adjustable biasing assembly 10 comprising power springs 17, inner spring housing 14 and outer spring housing 20 upon boss end 43 of bushing 16 and rotating spring housings 20, 21 in a counterclockwise fashion as shown by arrow 98, biasing of fixed members 111 and rotatable members 112 in the closing direction is provided.

Figure 1:
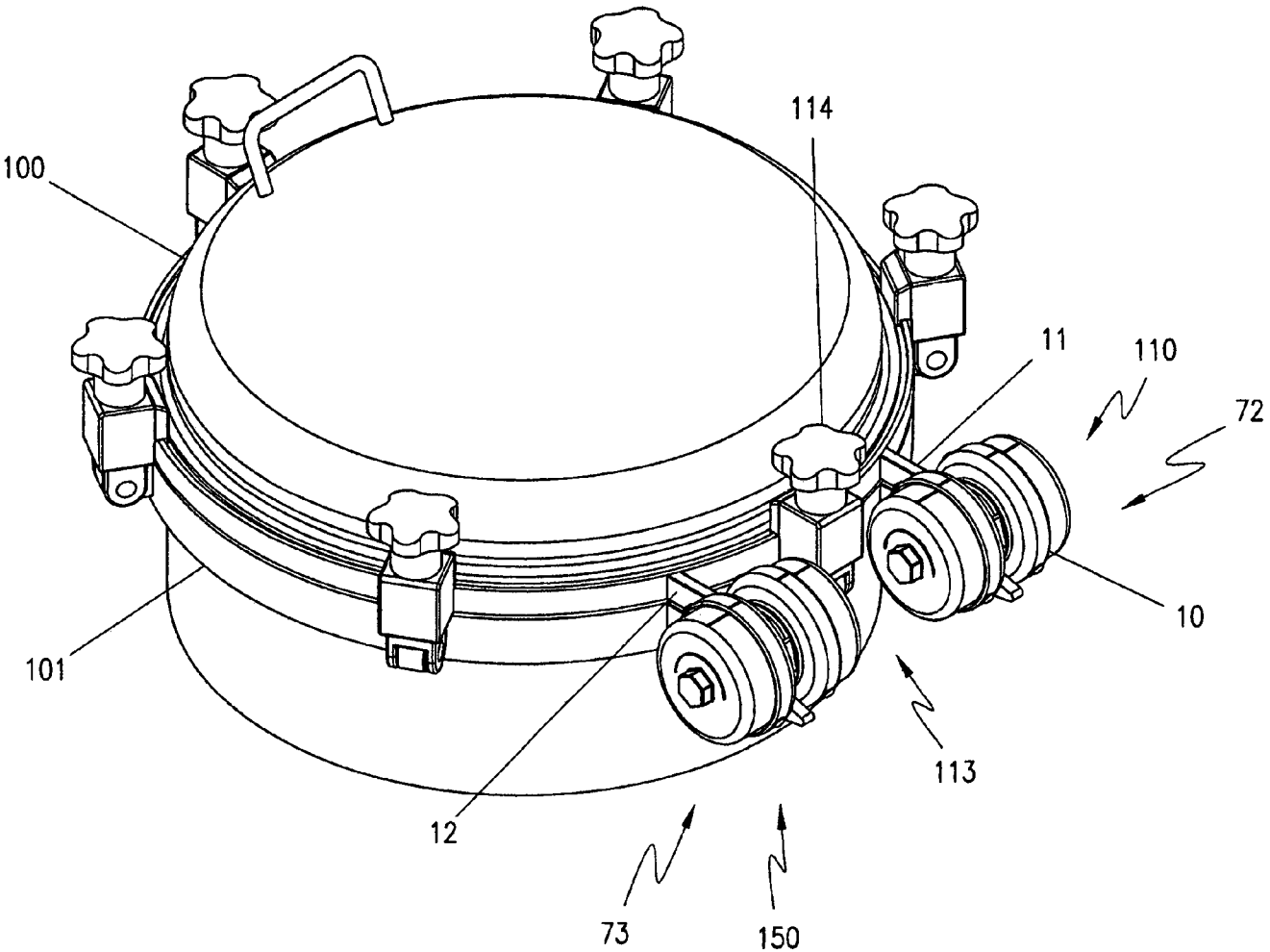
FIG. 1 is a perspective view of the preferred embodiment of the manway lift device of this invention having multiple lift assist assemblies shown installed on each hinge pair.

Multiple ways of adjusting the torque between fixed and rotatable members 111, 112, respectively, may be accomplished as follows. First, as hereinbefore recited, as outer spring housings 21, 20 are adjustably associated with inner spring housing 13, 14, respectively, one method of adjusting the torque between fixed member 111 and rotatable member 112 comprises one power spring 17 disposed within one housing pair 13/21 or 14/20 which is wound through any one of several incremental steps as stops 58 retain stops 61 at the end of each incremental step. Secondly, the available torque of adjustable biasing assembly 10 is adjustable by disposing an additional flat wire power spring 17 between mating housing pairs 13, 21 and/or 14, 20 and rotating outer spring housings 20 and/or 21 in the clockwise direction 99 through at least an angle to engage outer ends 50 of power springs 17 and by winding further to provide biasing force between fixed member 111 and rotatable member 112. Preferably, outer spring housings 20, 21 have six external pawls 54 disposed on external rim 63 thereof and inner spring housings 13, 14 have six internal ratchets 55 adapted to engage external pawls 54, six incremental positions may be achieved for each full rotation of outer spring housing 21, 20 with respect to inner spring housing 13, 14. By providing the same number of external pawls 54 and internal ratchets 55, housing pairs 13, 21 and 14, 20 substantially retain a parallel relationship thus providing for ease of rotation of outer spring housings 21, 20 with respect to inner spring housings 13, 14. Though six external pawls 54 and six internal ratchets 55 are recited in this application, it is within the scope of this invention to provide for more or fewer of either ratchets 55 or external pawls 54. A third method of increasing the available torque biasing rotatable member 112 from fixed member 111 is to provide a second biasing assembly 10 upon one bushing set 76 and rotating the respective outer spring housings 20, 21 to an incremental rotation to provide for the required torque. Fourth, additional torque may be provided by disposing additional adjustable biasing assemblies 10 upon both boss ends 43, 80 of both bushing sets 76 of each hinge pair 72, 73 as shown in FIG. 1 and rotating the respective outer spring housings 20, 21 through the required angle. Additionally, it is possible to provide for a progressive torque for manway lifting device 150 by providing biasing assemblies 10 on each boss end 43, 80 of bushing sets 76 and rotating at least one outer spring housing 20, 21 through one angle of rotation after engaging outer ends 50 of power springs 17 with internal lugs 51 and rotating at least one other outer spring housing 20, 21 through a different angle of rotation after engaging outer ends 50 of power springs 17 with internal lugs 51. Though it is preferable that the torque provided to each aligned pair 72, 73 of members 111, 112 is equal, it is possible to provide a nearly infinite number of combinations of torque through the use of multiple adjustable biasing assemblies 10, one or two power springs 17 within individual adjustable biasing assemblies 10 and the incremental rotation of outer spring housings 20, 21 with respect to inner spring housings 14, 13 respectively. Though only two lugs 51 are shown disposed upon peripheral wall 52, and four slots 49 are shown disposed in each bushing 15, 16, it is fully understood that the drawings and descriptions of these parts are illustrative of the concept of this invention and therefore the number of lugs 51 and slots 49 may be varied to provide for additional adjustability for adjustable biasing assemblies 10.

In some applications, it may be sufficient to provide only one adjustable biasing assembly 10 associated with fixed member 111 and movable member 112 and therefore, bushing set 76 need not have boss end 43 extend beyond external face 82 of fixed member 111. In this instance, a shortened bushing set 76' is used. Shortened bushing set 76' comprises bushing 15 fixedly engaged in movable member 112 and a reduced length bushing 16', shown spaced above bushing 16 which is rotatably disposed on a shortened shoulder bolt 19', reduced length bushing 16' having bearing surface 83 adjacent to boss end 43. As no power spring 17 is associated with reduced length bushing 16', no longitudinal slots 49 or annular grooves 47 are disposed into outer peripheral surface 48, however, shortened shoulder bolt 19' is passed through smooth internal bore 37 thereof and into internally threaded bore 36 of bushing which will receive threaded end 39 of shoulder bolt 19' therein as in other embodiments.

Rotatably associated fixed member 111 and rotatable member 112 are biased by power spring 17 into an opening relationship, however, fixed member 111 and rotatable member 112 have abutting stops 87, 102 respectively, to prevent relative movement beyond a predetermined angular displacement. Preferably, for a manway cover 100, stop 87 abuts stop 102 as manway cover 100 passes a substantially vertical position, however, stops 87, 102 may be provided to arrest movement of manway cover 100 at another position as required by the specific application. In the instant invention, adjustable biasing assembly 10 assists with biasing rotatable member 112 with respect to fixed member 111 to the desired position and thereafter a latch cusp 88 of a hatchet head protrusion 86 on the peripheral surface 103 of movable member 112 carrying stop 87 on one side thereof and a latch cusp 88 opposite stop 87 is engaged by a latch hook 91 of a latch mechanism 22 carried on fixed member 111. Latch mechanism 22 is rotatably disposed on a post 90, latch mechanism 22 comprising a latch arm 23 with latch hook 91 on one end 104 thereof, latch hook 91 engagable with latch cusp 88 carried by rotatable member 112 to arrest angular movement in a closing direction. Latch arm 23 has an ear 96 disposed adjacent an end 105 opposite end 104, ear 96 having a post hole 92 disposed therethrough for receiving a post (not shown) protruding from hidden side face 89' of a hinge arm 84 of fixed member 111. Latch arm 23 further has a spring receiving hole 106 in a top surface 107 thereof, spring receiving hole 106 receiving a compression spring 25 therein at assembly of latch mechanism 22 to fixed member 111. A retainer plate 24 has a post hole 93 disposed therethrough for being received over a post 90 protruding from the exposed side face 89, retainer plate 24 and latch arm 23 having matching retainer holes 94, 95 respectively, therethrough. Holes 94 are threaded for receiving the threads of cap screws 26 to retain latch mechanism 22 upon fixed member 111.

In an alternate embodiment, lift assist assembly 110' of this invention may comprise only one pair 72, 73 of rotatably associated members 111, 112, a central bushing set 76 and a biasing device 115 such as a flat spiral wound power spring 17, one of members 111 having central bushing set 76 rotatably associated therein, the other of said members 112 having central bushing set 76 affixed thereto and rotatably pivotable upon bearing surface 83 of bushing set 76. Rotatably associated members 111, 112 are biased relative one to the other by biasing device 115, biasing device 115 having an inner end 40 thereof affixed to central bushing set 76 and outer end 50 thereof affixed to member 111 on a post 116 protruding from exterior face 81 and/or 82 of member 111. Lift assist assembly 110' may have members 111, 112 affixed to the respective parts of the associated application, members 111 and 112 aligned for receiving bushing set 76 therethrough and thereafter have power spring 17 inserted into one longitudinal slot 49. Power spring 17 is then rotated through an angular displacement equal to the torque required for biasing members 111 and 112 in the required direction wherein outer end 50 of power spring 17 is displaced from the plane of power spring 17 a sufficient amount to place outer end 50 over post 116. In this alternate embodiment, power spring 17 and central bushing set 76 are exposed to the environment, however, since preferably power spring 17 and central bushing set 76 are made from stainless steel, chromed steel or the like, exposure to the environment is not detrimental. As with other embodiments in this invention, more than one lift assist assembly 110' may be associated with multiple pairs 72, 73 of members 111, 112 to provide for additional torque. Additionally, multiple power springs 17 may be disposed upon central bushing set 76.

In another alternate embodiment, post 126 may be disposed on internal surface 62 of inner spring housing 13 or 14 and power spring 17 thereafter placed in longitudinal slot 49 of bushing set 76. By rotating inner spring housing 13 or 14 with respect to fixed member 111 with outer end 50 of power spring 17 engaged with post 126 and engaging octagonal aperture 45 of inner spring housing 13 or 14 with octagonal protrusion 44 on fixed member 111, rotatable member 112 is biased with respect to fixed member 111. Power spring 17 may then be retained in position on bushing set 76 by retainer clip 18 placed in annular groove 47, 47' thus also retaining inner spring housing 13 or 14 against fixed member 111 and maintaining the torque relationship between fixed member 111 and rotatable member 112.

Referring to FIGS. 1 and 2, a manway lift device 150 comprises a right and a left upper hinge bracket 12, a right and a left lower hinge bracket 11, at least two smooth bore bushings 16, at least two internally threaded bushings 15 and at least one adjustable biasing assembly 10. Upper hinge brackets 12 are arranged in a parallel relationship, spaced apart and rigidly attached to manway cover 100 to be lifted. Lower hinge brackets 11 are similarly arranged in a parallel relationship, spaced apart and rigidly affixed to manway collar assembly 101 for receiving manway cover 100. Right upper hinge bracket 12 is aligned with right lower hinge bracket 11 thus constituting a right-aligned pair 72 and left upper hinge bracket 12 is aligned with left lower hinge bracket 11 thus constituting a left-aligned pair 73. Right-aligned pair 72 receives one of smooth bore bushings 16 and one of internally threaded bushings 15 therethrough from opposite directions 74, 75 thus comprising a bushing set 76. In like manner, left-aligned pair 73 receives one of smooth bore bushings 16 and one of internally threaded bushings 15 therethrough from opposite directions 74, 75 thus comprising another bushing set 76. In each bushing set 76, at least one of bushings 15, 16 has a boss 78, 79 on one boss end 80, 43 thereof respectively, boss 78, 79 protruding beyond an exterior face 81, 82 of lower hinge bracket 11. Bushings 15, 16 further have dogs 29 disposed on the opposite end 30, 31 thereof, dogs 29 engaged in dog holes 35 disposed through upper hinge bracket 12. Smoothbore bushing 16 of bushing set 76 receives shoulder bolt 19 through internal bore 37 thereof and internally threaded bushing 15 of bushing set 76 threadedly receives the threaded end 39 of shoulder bolt 19 in internally threaded bore 36 thereof. Thus, shoulder bolt 19 rigidly affixes bushing set 76 to upper hinge bracket 12 and thereby rotatably affixes manway cover 100 to manway collar assembly 101, at least one of bosses 78 of aligned pairs 72, 73 having adjustable biasing assembly 10 associated therewith. Likewise, smooth bore bushing 16 of the other bushing set 76 receives shoulder bolt 19 through internal bore 37 thereof, internally threaded bushing 15 of the other bushing set 76 threadedly receiving the threaded end 39 of shoulder bolt 19 in internally threaded bore 36 thereof, shoulder bolt 19 thus rigidly affixing the other bushing set 76 to upper hinge bracket 12 and thereby rotatably affixing manway cover 100 to manway collar assembly 101, at least one of bosses 79 of both aligned pairs 72, 73 also having adjustable biasing assembly 10 associated therewith. Additionally, each boss 78, 79 of each bushing set 76 may have adjustable biasing assembly 10 associated therewith for providing additional lifting force for manway cover 100. In the preferred embodiment, adjustable biasing assembly 10 is retained on left-aligned pair 73 of members by retainer clip 18 disposed in annular groove 47 about bushing 15 adjacent at least one power spring 17 and adjustable biasing assembly 10 is retained on right-aligned pair 72 of members by retainer clip 18 disposed in annular groove 47 about bushing 15 adjacent at least one power spring 17. Manway lift device 150 having adjustable biasing assembly 10 disposed on boss 78, 79 protruding from exterior face 81, 82 of left-aligned pair 73 of members thus constitutes a left lift assist assembly 110 and adjustable biasing assembly 10 disposed on boss 78, 79 protruding from exterior face 81, 82 of right-aligned pair 72 of members thereby constitutes a right lift assist assembly 110. As a space 113 is left between right lift assembly 110 and left lift assembly 110, a manway retaining clamp 114 may be located between left-aligned pair 73 of members and right-aligned pair 72 of members. For many biasing operations, especially those biasing operations requiring considerable biasing force, left lift assist assembly 110 disposed on left-aligned pair 73 of members comprises two opposed co-acting adjustable biasing assemblies 10 and right lift assist assembly 110 disposed on right-aligned pair 72 of members comprises two opposed co-acting adjustable biasing assemblies 10, left lift assist assembly 110 and right lift assist assembly 110 separately adjustable. The lifting torque of left lift assist assembly 110 is externally adjustable by gripping outer spring housing 20 and/or 21 by hand and rotating same through an angular displacement engaging internal ratchets 55 with external pawls 54 and the lifting torque of right lift assist assembly 110 likewise externally adjustable in the same manner or by engaging hexagonal boss 69 with a wrench and rotating spring housing 20 or 21 through the same or another angle of rotation.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

I claim:

1. A manway lift device comprises a first and a second upper hinge bracket, a third and a fourth lower hinge bracket, at least two smooth bore bushings, at least two internally threaded bushings and at least one adjustable biasing assembly, said upper hinge brackets arranged in a parallel relationship with each other, spaced apart from each other and rigidly attached to a manway cover to be lifted, said lower hinge brackets arranged in a parallel relationship with each other, spaced apart from each other and rigidly affixed to a manway collar assembly for receiving said manway cover, said first upper hinge bracket aligned with said third lower hinge bracket thus constituting a first aligned pair of said brackets, said second upper hinge bracket aligned with said fourth lower hinge bracket thus constituting a second aligned pair of said brackets, said first aligned pair of said brackets receiving one of said smooth bore bushings therein from a first direction and receiving one of said internally threaded bushings therein from a second direction opposite to said first direction, said one of said smooth bore bushings and said one of said internally threaded bushings comprising a first bushing set, said second aligned pair of said brackets receiving the other one of said smooth bore bushings therein from a third direction and receiving the other one of said internally threaded bushings therein from a fourth direction opposite to said third direction, said other one of said smooth bore bushings and said other one of said internally threaded bushings comprising a second bushing set, at least one of said bushings of said first bushing set having a first end thereof protruding beyond an exterior face of said third lower hinge bracket, said at least one bushing having dogs disposed on a second end thereof opposite to said first end thereof, said dogs engaged in dog holes disposed through said first upper hinge bracket, said smooth bore bushing of said first bushing set receiving a bolt through the internal bore thereof, said internally threaded bushing of said first bushing set threadedly receiving the threaded end of said bolt, said bolt thus rigidly affixing said first bushing set to said first upper hinge bracket and thereby rotatably affixing said manway cover to said manway collar assembly, said at least one bushing of said first bushing set having said adjustable biasing assembly associated therewith for biasing said manway cover into an open position with respect to said manway collar assembly.

2. A manway lift device as in claim 1 wherein said adjustable biasing assembly comprises mating inner and outer housings and at least one flat wire spiral wound spring, said spring disposed between said inner and said outer housings, said outer housing rotatably engaged in said inner housing, said outer housing having at least one internal lug engageable with an outer end of said spring.

3. A manway lift device as in claim 2 wherein said adjustable biasing assembly is associated with a fixed member comprising said third lower hinge bracket, said first bushing set and a rotatable member comprising said first upper hinge bracket for angularly biasing said rotatable member with respect to said fixed member.

4. A manway lift device as in claim 3 wherein said inner housing is carried by said fixed member, said fixed member has said first bushing set passing therethrough, said first bushing set fixedly engaged in said rotatable member, said first bushing set receiving and retaining an inner end of said spring therein.

5. A manway lift device as in claim 4 wherein said spring biases said rotatable member relative to said fixed member.

6. A manway lift device as in claim 5 wherein said fixed and rotatable members have abutting stops to prevent relative movement beyond a predetermined angular displacement.

7. A manway lift device as in claim 6 wherein said fixed member has a latch mechanism rotatably associated therewith, said latch mechanism comprising a latch arm having a latch hook on one end thereof, said latch hook engagable with a latch cusp carried by said rotatable member to arrest angular movement of said manway cover relative to said manway collar assembly in a closing direction.

8. A manway lift device as in claim 4 wherein said rotatable member is affixed to said manway cover and said fixed member is fixed to said manway collar assembly, said rotatable member and said fixed member constituting a hinge pair.

9. A manway lift device as in claim 8 wherein a torque produced by said biasing assembly is adjustable by disposing an additional flat wire spring between said mating housings.

10. A manway lift device as in claim 2 wherein said outer end of said flat wire spring is curved.

11. A manway lift device as in claim 10 wherein said outer housing has at least one stop disposed on an outer rim thereof adapted to engage internally disposed stops on said mating inner housing.

12. A manway lift device as in claim 11 wherein said outer rim of said outer housing comprises six external stops.

13. A manway lift device as in claim 12 wherein said mating inner housing has six internal stops.

14. A manway lift device as in claim 1 wherein said adjustable biasing assembly is retained on said first-aligned pair of said brackets and an additional adjustable biasing assembly is retained on said second-aligned pair of said brackets.

15. A manway lift device as in claim 1 wherein said adjustable biasing assembly is disposed on said first bushing set and comprises a left lift assist assembly and an additional adjustable biasing assembly is disposed on said second bushing set and comprises a right lift assist assembly.

16. A manway lift device as in claim 15 wherein said left lift assist assembly comprises two opposed co-acting biasing assemblies and said right lift assist assembly comprises two opposed co-acting biasing assemblies, said left lift assist assembly being and said right lift assist assembly separately adjustable.

17. A manway lift device as in claim 1 wherein a manway retaining clamp is located between said first aligned pair of said brackets and said second aligned pair of said brackets.

* * * * *